United States Patent [19]

Noren

[11] 3,985,226

[45] Oct. 12, 1976

[54] ARCUATE-SHAPED MODULARS FOR A COMMERCIAL DISHWASHING MACHINE

[76] Inventor: Tore H. Noren, 3200 Lakeview Highway, Petaluma, Calif. 94952

[22] Filed: Dec. 10, 1974

[21] Appl. No.: 531,374

Related U.S. Application Data

[62] Division of Ser. No. 286,448, Sept. 5, 1972, abandoned.

[52] U.S. Cl. ..... 198/738; 134/83; 134/133; 198/747

[51] Int. Cl.[2] ..... B08B 3/02

[58] Field of Search ..... 134/49, 61, 66, 68, 134/77, 82, 83, 133, 165; 198/221

[56] References Cited

UNITED STATES PATENTS

| | | | |
|---|---|---|---|
| 1,259,653 | 3/1918 | Masterman | 134/83 X |
| 1,462,511 | 7/1923 | Lister | 198/221 X |
| 1,509,254 | 9/1924 | Pilley | 198/221 X |
| 2,550,523 | 4/1951 | Borgerding | 134/49 X |
| 2,609,916 | 9/1952 | Kendall | 198/221 X |
| 3,128,875 | 4/1964 | Kay et al. | 198/221 |
| 3,221,754 | 12/1965 | Robson et al. | 134/68 |
| 3,384,097 | 5/1968 | Meeker et al. | 134/68 X |

*Primary Examiner*—Robert L. Bleutge
*Attorney, Agent, or Firm*—William R. Piper

[57] ABSTRACT

A commercial dishwasher comprising two or more modulars connected together through which dish-carrying baskets are moved for washing and rinsing the dishes, one or more of the modulars being arcuate-shaped so as to alter a straight line movement of the baskets into one where they are swung through a 90° angle. By connecting two of the arcuate-shaped modulars together, it is possible to swing the dish-carrying baskets through an arc of 180°. Therefore the dish-washer can be positioned in the corner of a room and thus make use of space that would otherwise not be used.

2 Claims, 20 Drawing Figures

ARCUATE-SHAPED MODULARS FOR A COMMERCIAL DISHWASHING MACHINE

This application is a division of my copending patent application on arcuate-shaped modulars for commercial dishwashing machine, filed Sept. 5, 1972, Ser. No. 286,448, now abandoned. In this case the claims will be directed to a dishwashing machine having sequential work treating stations.

SUMMARY OF THE INVENTION

An object of my invention is to provide an arcuate-shaped modular that forms a unit in a commercial dishwashing machine, this modular changing the direction of travel of the dish-conveying baskets through an arc of 90°. By connecting two of these arcuate-shaped modulars together, it is possible to change the travel of the baskets through an arc of 180°. The arcuate-shaped modular may be equipped to operate as a power scrapper, power wash, or a power rinse.

A further object of my invention is to provide one or more arcuate-shaped modulars that can be interconnected with other linear units to form commercial dishwashing machines having different configurations, such as for example an S shape. This is particularly advantageous when an isolation of the loading and unloading ends of the dishwasher must be in different rooms, such as in many hospital dishroom layouts.

DESCRIPTION OF THE PREFERRED EMBODIMENT

Figures 1, 1A:
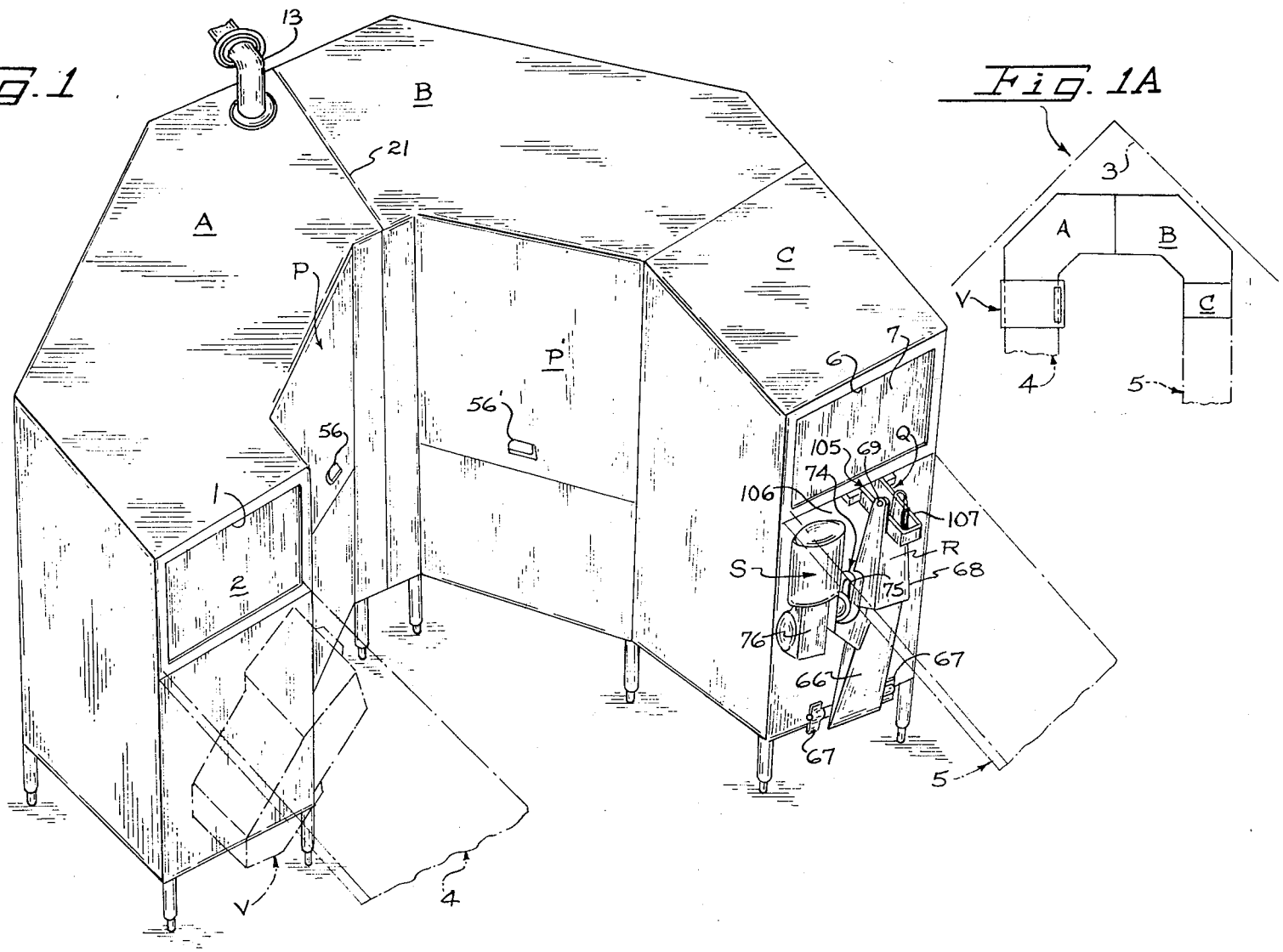
FIG. 1 is an isometric view of my commercial dishwashing machine in which two of the arcuate-shaped modulars are used so that the dish-conveying baskets will travel through an arc of 180° from the inlet end of the machine to the exit end.
FIG. 1A is a schematic plan view of FIG. 1 and shown on a smaller scale and illustrating how the machine may be positioned in the corner of a room thereby utilizing what would otherwise be lost space.

In carrying out my invention I illustrate in FIG. 1 a commercial dishwashing machine using two of my arcuate-shaped modulars, indicated generally at A and B. The modular A is for a power scrapper while the modular B is for a power wash. The two modulars A and B are interconnected and I will describe the mechanism for step-wise advancing a dish-carrying basket from the modular A into the modular B after the operator has inserted the basket into the entrance opening 1 for the power scrapper A. A curtain 2 normally covers the opening 1 in order to prevent water from the spray manifolds, hereinafter set forth, from escaping through the opening 1. FIG. 1 further shows the power wash B being connected to a final rinse modular or unit indicated generally at C.

A schematic showing of the three modulars A, B and C, indicated in FIG. 1A, illustrates how the dishwashing machine may be placed in the corner 3 of a room and thus occupy what would normally be unused or lost space. Both FIGS. 1 and 1A show how a feed table 4, see the dot-dash lines, is positioned adjacent to the entrance opening 1 to permit dish-carrying baskets to be manually moved into the power scrapper A, and how a receiving table 5, see the dot-dash lines, is positioned adjacent to an exit opening 6 to receive the basket containing the washed and sterilized dishes. A curtain 7 covers the exit opening 6 and prevents water from the hot water dish rinsing spray manifolds, hereinafter described, from escaping through the opening.

Figure 2:
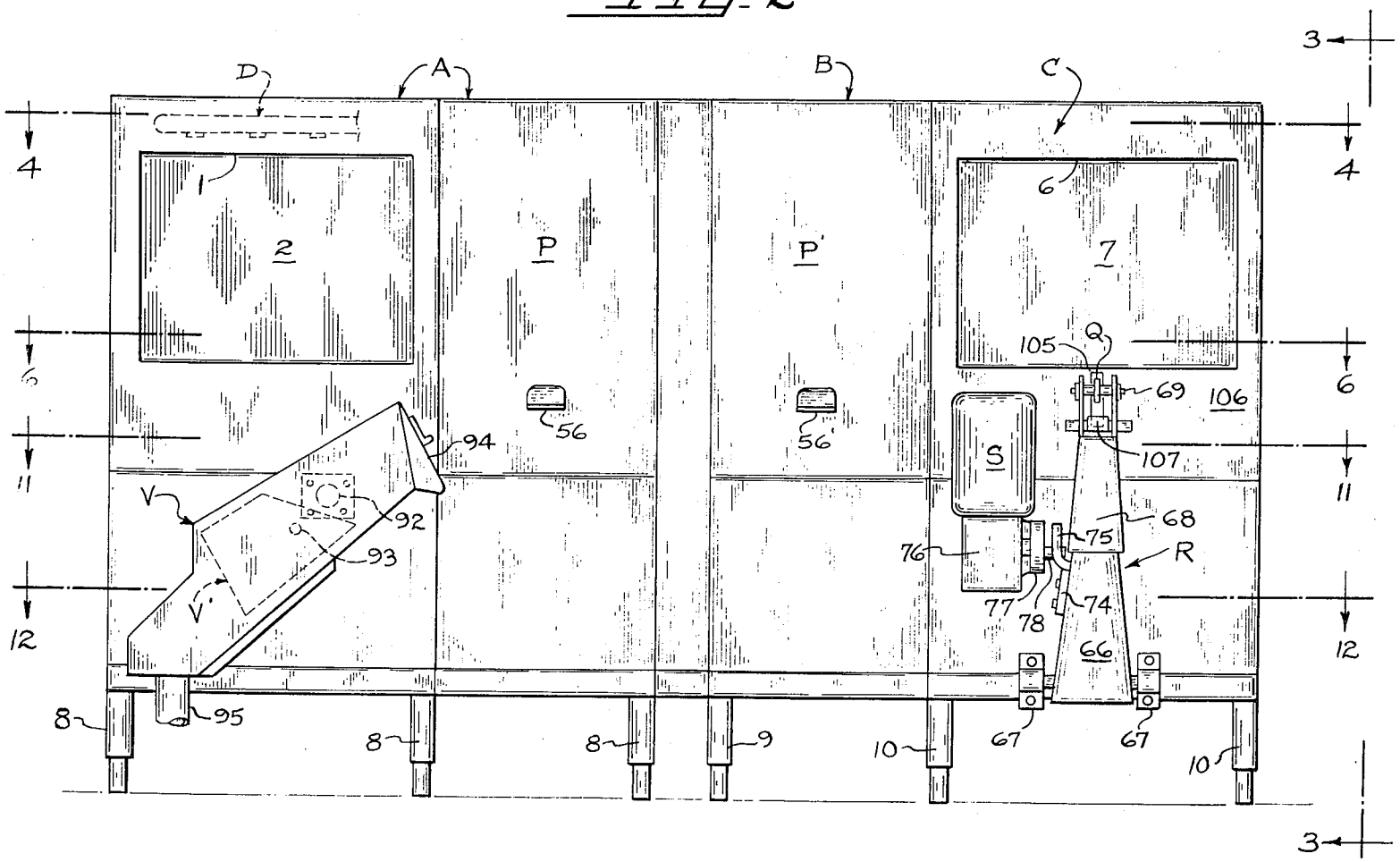
FIG. 2 is a front elevation of the dishwashing machine shown in FIG. 1, and illustrating the entrance and exit ends of the machine.
Figure 13:
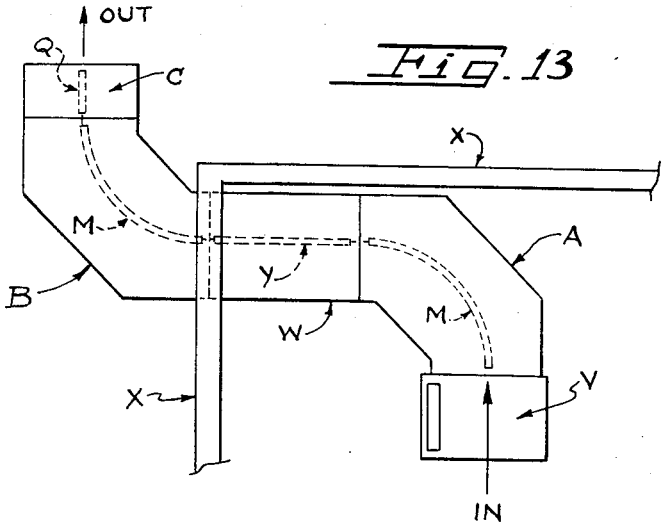
FIGS. 13, 14 and 15 are schematic showings of how one or more of the arcuate-shaped modulars may be interconnected with other units in the dishwashing machine for providing machines that have different configurations to fit different requirements.
Figure 14:
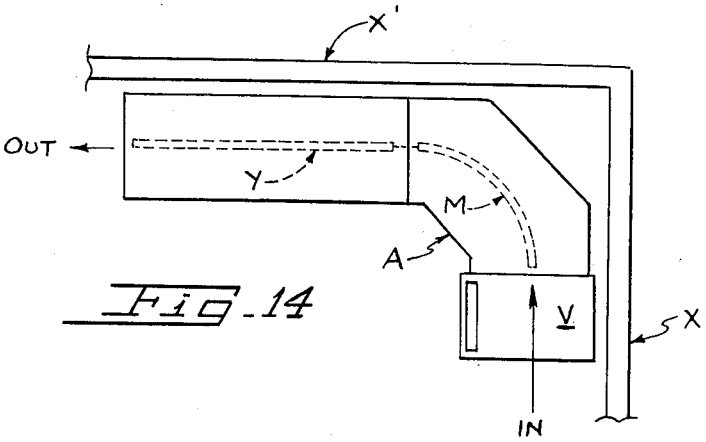
Figure 15:
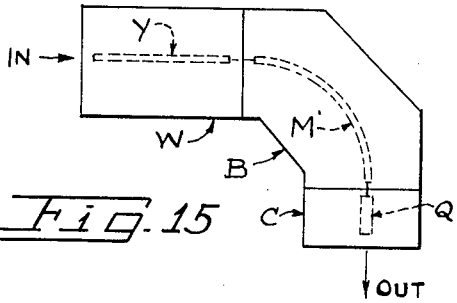

In FIG. 2, I show a front elevation of the dishwashing machine shown in FIG. 1. The feed table 4 and the receiving table 5 are not shown in this Figure. A plurality of horizontal sections are taken through the machine at different levels and these are indicated by the section lines 4—4; 6—6; 11—11; and 12—12. These various horizontal sections illustrate different parts of the dishwashing machine. The modular A is supported by legs 8; the modular B is supported by the legs 9, see also the side view of the machine in FIG. 3; and the final rinse modular C is supported by the legs 10. The modulars A and B in FIG. 1 are shown as a power scrapper and a power wash, respectively, and these feed the scrapped and washed dishes into the final rinse. It is possible to have one of the arcuate-shaped modulars function as a power rinse and later on I will show in FIG. 13 how one of the modulars is a power rinse. In fact, FIGS. 13, 14 and 15 illustrate different combinations of the modulars which will be explained after the various mechanisms are described in detail.

Figures 4, 5:
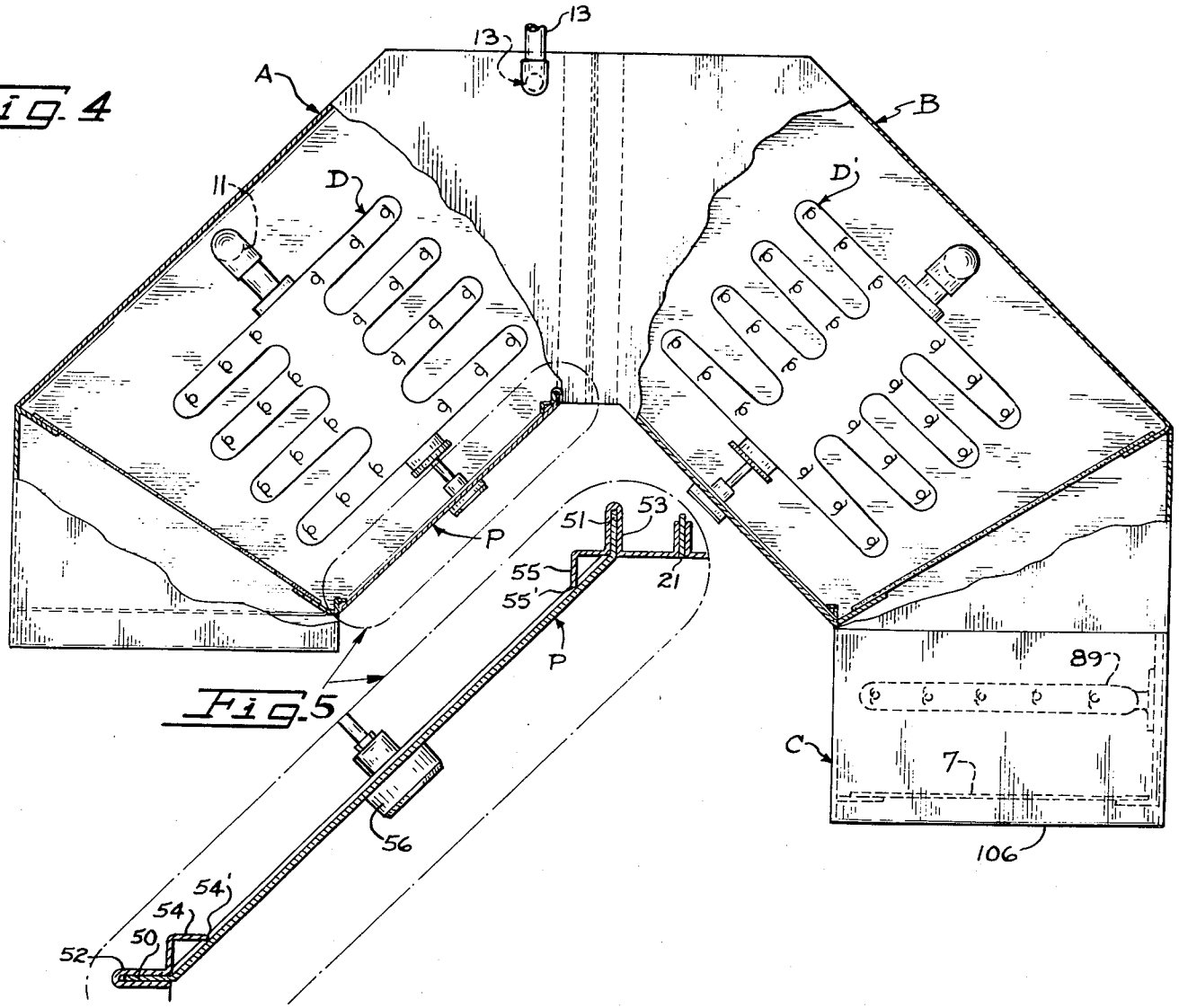
FIG. 4 is a horizontal section through the dishwashing machine and is taken along the line 4—4 of FIG. 2. The upper spray arms in both of the arcuate-shaped modulars are shown by full lines while the upper rinse arm is indicated by dotted lines.
FIG. 5 is an enlarged horizontal section of the portion of FIG. 4 that is enclosed in an oval dot-dash line and discloses how one of the vertical sliding inspection doors moves in waterproof door guides.
Figures 11, 11A, 11B:
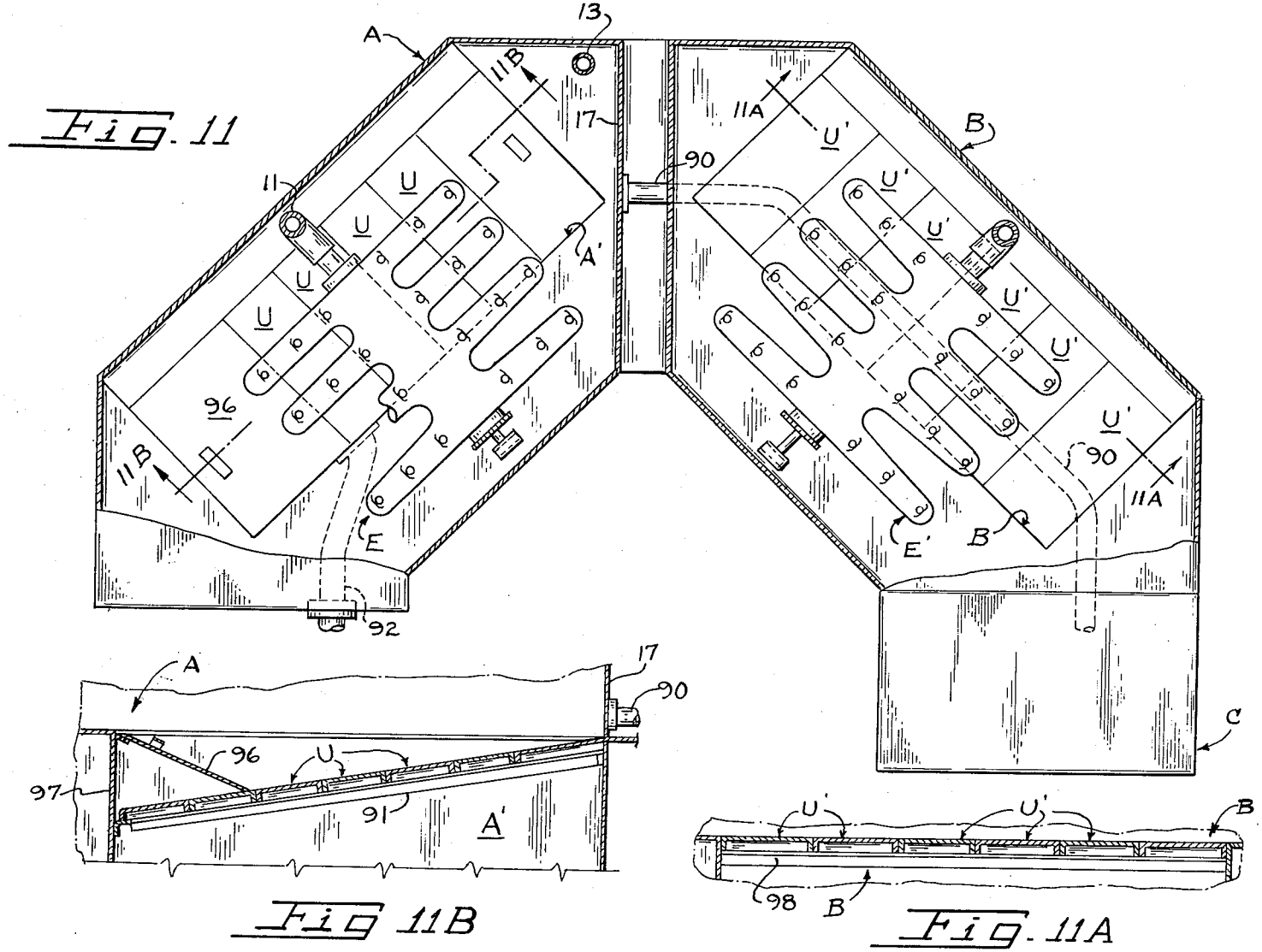
FIG. 11 is a third horizontal section through the dishwashing machine and is taken along the line 11—11 of FIG. 2 and shows the removable screens that are mounted in the two arcuate-shaped modulars and extend over the water tanks in both modulars and underlie the lower spray manifolds that are removably mounted in these modulars.
FIG. 11A is a longitudinal vertical section through one of the arcuate-shaped modulars and illustrates the removable screens and how they lie in a horizontal plane.
FIG. 11B is a longitudinal vertical section through the other arcuate-shaped modular and shows the removable screens lying in a downwardly inclined plane for conveying food soil toward one end of the modular.
Figure 12:
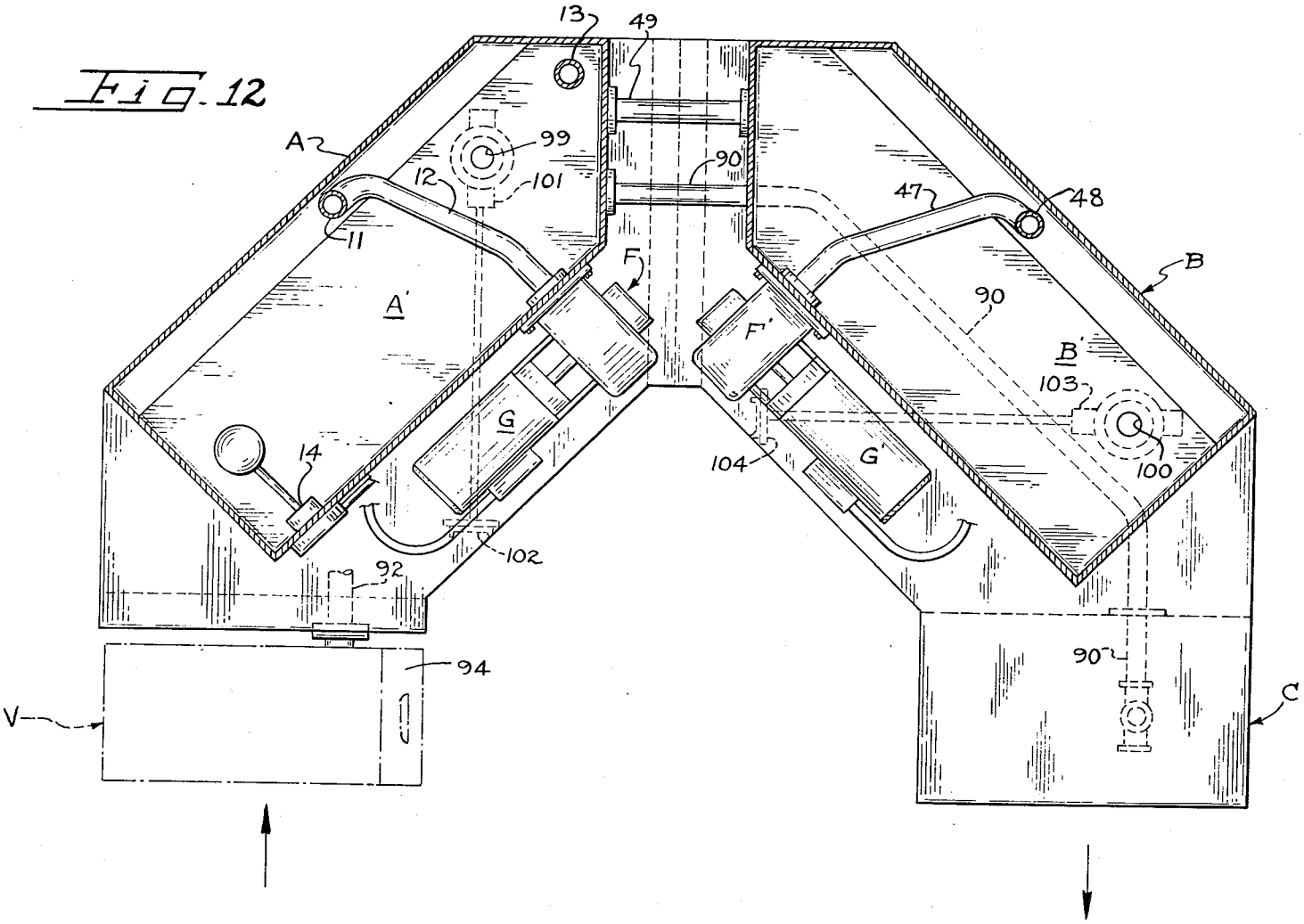
FIG. 12 is a fourth horizontal section and is taken along the line 12—12 of FIG. 2 and illustrates the means for pumping water to the upper and lower manifolds in the two arcuate-shaped modulars.

FIG. 4 is the uppermost horizontal section taken in FIG. 2, and portions of FIG. 4 are shown in elevation. An upper water spray manifold D is illustrated as being removably mounted in the power scrapper A. A lower water spray manifold E is shown in FIG. 11 and it is positioned directly under the upper manifold D and may be removed from the modular A. A common vertical pipe 11 interconnects the two manifolds D and E and FIG. 12 shows a pipe 12 leading from a water pump F and communicating with the vertical pipe 11. The modular A has a tank A′ that underlies the lower spray manifold E and receives the water from both of the manifolds D and E after this water has been directed against the dishes for washing them. The pump F is operated by an electric motor G and draws water from the tank A′ and delivers it to the pipes 12 and 11 and the two manifolds D and E. I have found that a thorough cleaning of the dishes can be accomplished by having the pump deliver about 185 gallons a minute to the pipe 12, although I do not wish to be limited to any specific number of gallons. The type of manifolds used are shown in my U.S. Pat. Nos. 3,415,259 and 3,457,958.

Any means desired may be used for initially supplying the tank A′, see FIG. 12, with hot water at a temperature of about 140°. I have shown a hot water inlet pipe 13 extending down into the tank A′ for delivering hot water thereto when a dishwashing machine starting button, not shown, is depressed. A float-controlled switch, indicated generally at 14 in FIG. 12, automatically closes the inlet valve, not shown, for the pipe 13, when the water in the tank A′ reaches a predetermined level. The switch 14 will close when the water level in the tank A′ is lowered beyond a predetermined point and again the inlet valve, not shown, will be opened for delivering hot water into the tank. In this way the hot water in the tank is maintained at the proper level, automatically. An overflow pipe, not shown, is also provided in the tank and will drain off any excess water.

Figure 6:
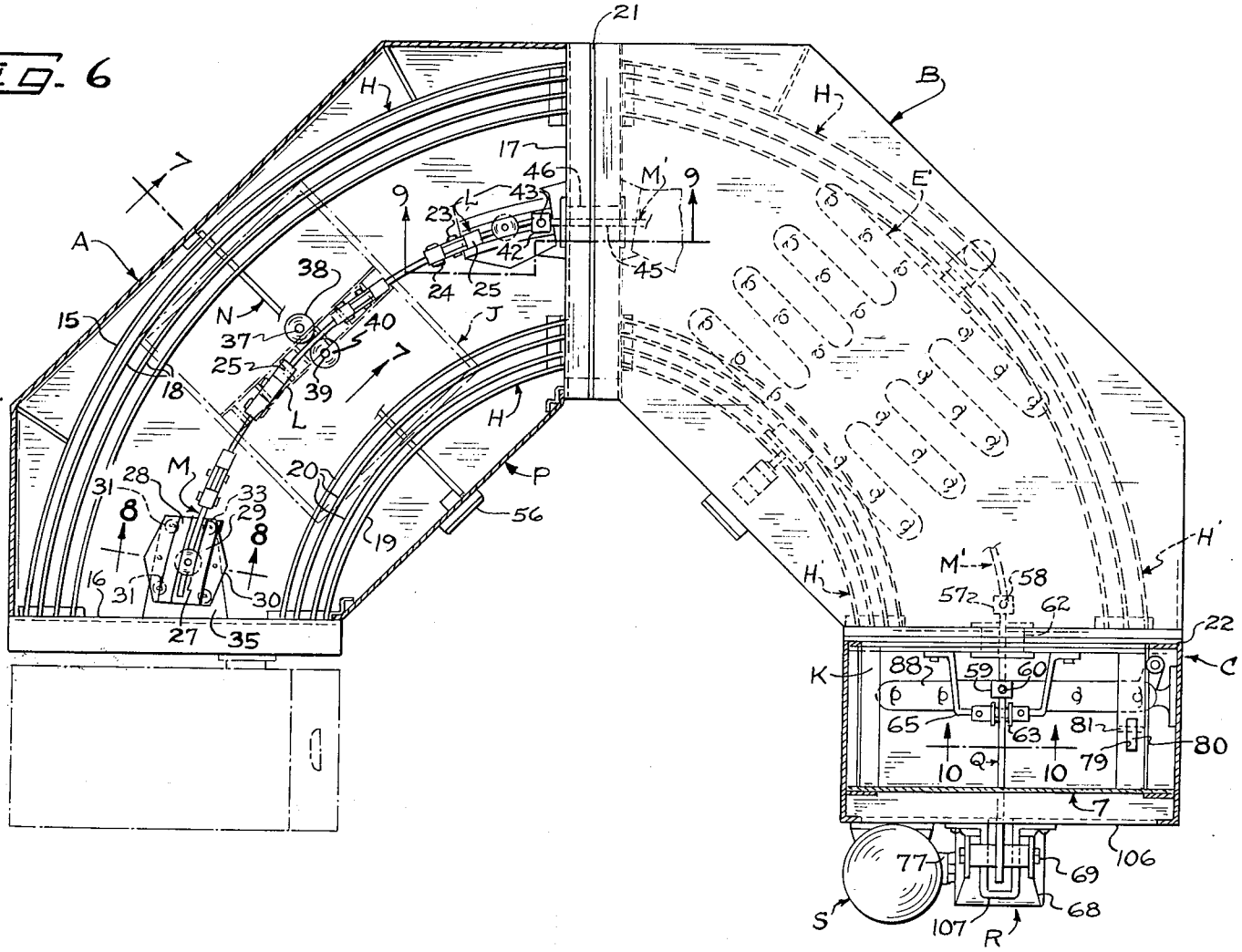
FIG. 6 is another horizontal section through FIG. 2 and shows the arcuate-shaped pawl-carrying bar that is reciprocated for step-wise advancing the dish-conveying baskets through the two arcuate-shaped modulars.

I will now describe the mechanism for supporting and stepwise advancing dish-carrying baskets through the two modulars A and B, that are connected together, as shown in FIG. 6. This mechanism will also stepwise advance the baskets through the final rinse modular C. An arcuate basket carrying track, indicated generally at H, is mounted in the modular A, and a similar arcuate track H′ is mounted in the modular B. Therefore, a detailed description of the arcuate track H in the modular A will suffice for both tracks and the reference characters for the track H′ will be primed.

Figure 7:
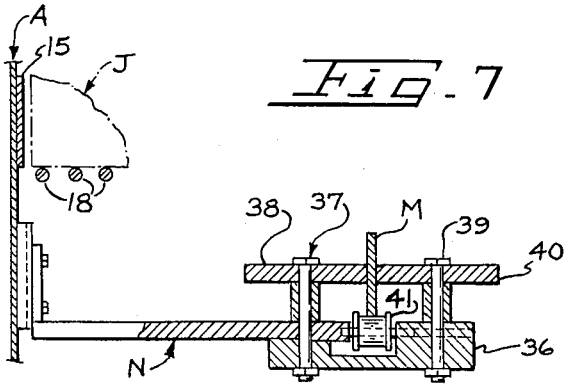
FIG. 7 is an enlarged transverse section through a portion of the dishwashing machine and is taken along the line 7—7 of FIG. 6, in order to illustrate the central adjustable support for the arcuate-shaped pawl carrying bar.

In FIGS. 6 and 7, I show an outer arcuate strip 15 that extends between the end walls 16 and 17 of the modular A and is fastened thereto. A plurality of arcuate and concentrically arranged basket supporting rods 18 are spaced slightly from each other and from the arcuate strip 15 and have their ends supported by the end walls 16 and 17. The arcuate rods 18 lie in a horizontal plane that in turn lies in the same plane as the feed table 4, shown in FIG. 1, so that an operator can move a dish-carrying basket from the feed table, pass it through the entrance opening 1 of the modular A where the arcuate rods 18 will support one side of the basket as shown in FIG. 7.

An inner arcuate strip 19 for the arcuate track H is shown in FIG. 6 and it has its ends supported by the end walls 16 and 17 of the modular A. The arcuate strip 19 is concentric to the outer arcuate strip 15. A plurality of arcuate and concentrically arranged basket supporting rods 20 are spaced slightly from each other and from the strip 19 and have their ends secured to the end walls 16 and 17. The arcuate rods 20 lie in the same horizontal plane as occupied by the arcuate rods 18 and both the rods 18 and 20 slidably support a dish-carrying basket J, indicated by the dot-dash lines in FIGS. 6 and 7. The arcuate track H will swing the basket J through an arc of 90° as the basket is stepwise moved through the arcuate-shaped modular A. The modular A communicates with the modular B at their point of connection and the openings between the two modulars is large enough to permit the basket to pass from one to the other, the basket being supported by the arcuate track H′ when received in the modular B. The abutting rims of the two modulars A and B are hermetically sealed together by a gasket 21, as shown in FIG. 6, and the two modulars are clamped together by any means desired, none being shown.

Figures 3, 3A:
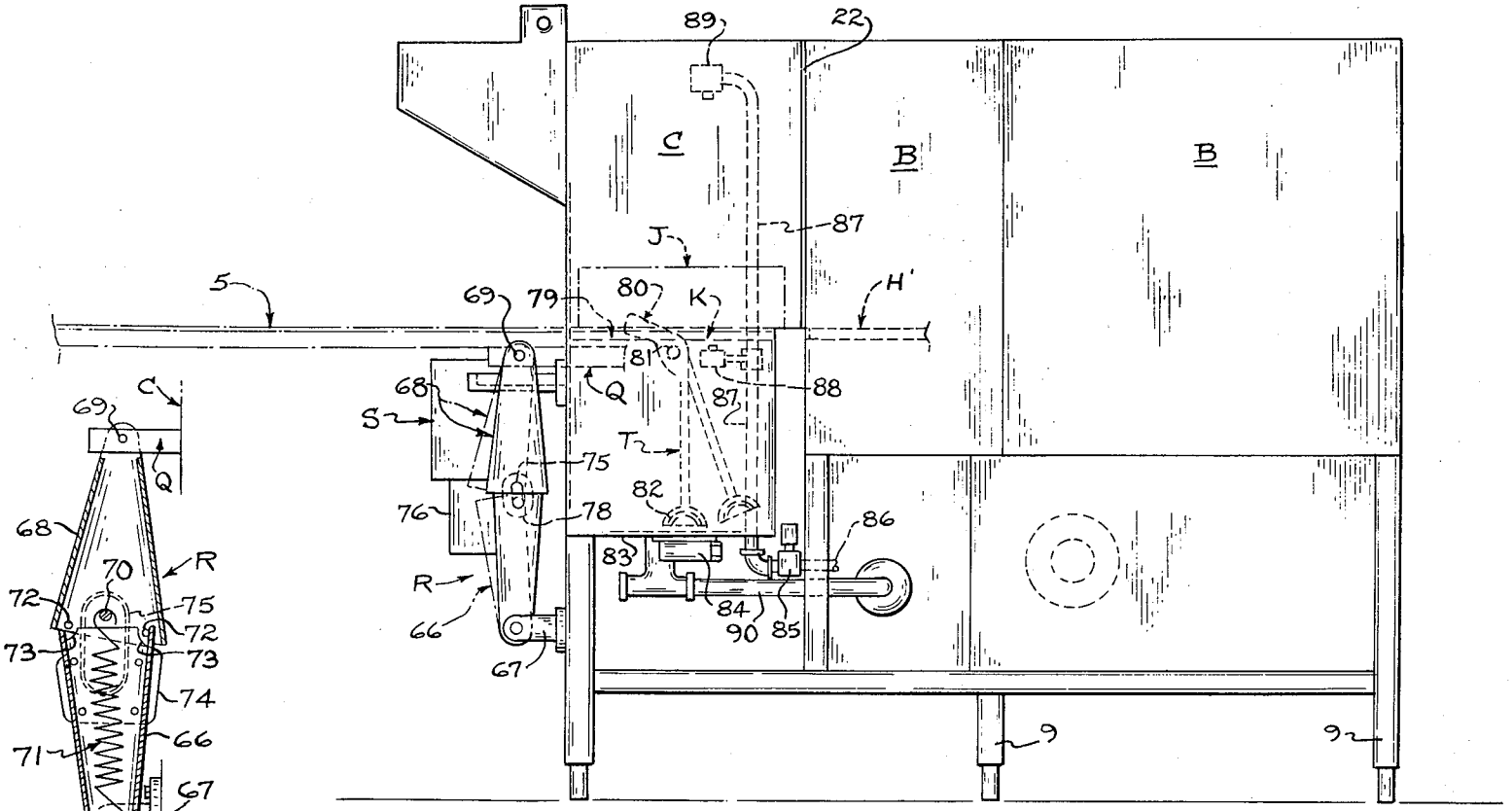
FIG. 3 is a side elevation of the dishwashing machine when looking from the right hand side of FIG. 2 as indicated by the arrows 3—3 in that Figure.
FIG. 3A is a vertical section through the jamb proof yielding lever that is shown in FIG. 3.

Before describing the mechanism for stepwise advancing the basket through both of the modulars A and B, it is best first to state that the final rinse modular C is also hermetically sealed to the outlet end of the modular B by a sealing gasket 22 and the two modulars are clamped together by any means desired, none being shown. The opening between the modulars B and C is large enough to permit the basket J to pass therethrough. FIG. 3 shows a side elevation of the final rinse modular C and illustrates the basket J passing from the arcuate track H′, and onto a straight track K in the final rinse. The straight track K lies in the same horizontal plane as the basket-receiving table 5 and permits the basket with its washed and rinsed dishes to be received on the table 5.

Figure 9A:
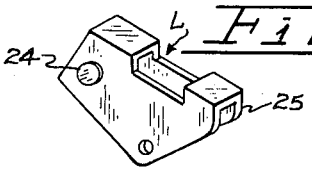
FIG. 9A is an enlarged isometric view of one of the basket moving pawls.
Figure 9:
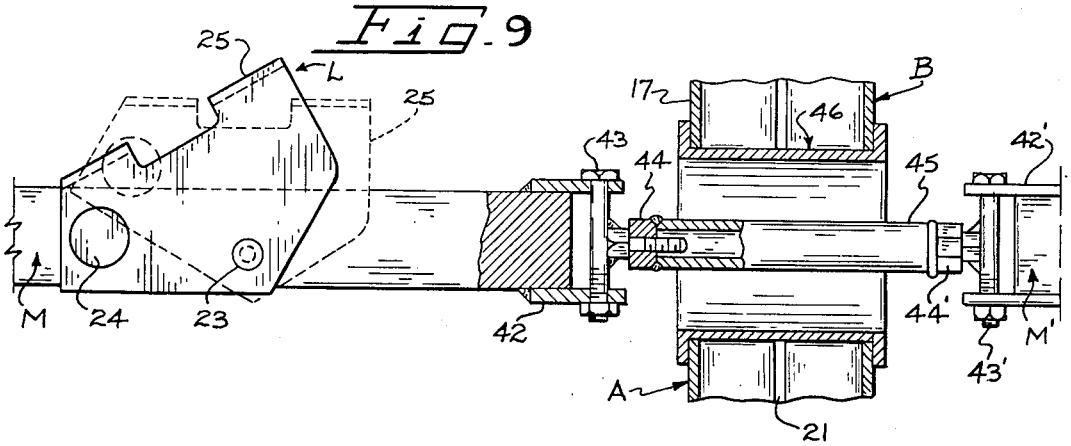
FIG. 9 illustrates on a larger scale a vertical section taken along the line 9—9 of FIG. 6, showing how the adjacent ends of two of the arcuate pawl-carrying bars are adjustably interconnected.

I will now describe the means for stepwise advancing the basket J through the three modulars A, B and C. Referring to FIG. 6, it will be seen that the standard dish-carrying basket J has a central ladder-like structure with spaced apart rungs 22 against which pawls engage for advancing the basket. The pawls L are pivotally mounted at 23 to an arcuate bar M that is reciprocated by a means hereinafter described, see also FIG. 9. The pawl L is made out of sheet metal and is stamped and bent into the shape shown by the isometric view of FIG. 9A. The pawl is weighted by weights 24 and they incline the pawl upwardly as shown in FIG. 9, when in normal position. The nose 25 of the pawl is received in the space between two adjacent rungs 22 in the basket J, see FIG. 6, and a clockwise movement of the arcuate bar M will cause the pawl to advance the basket in the modular A.

Figure 8:
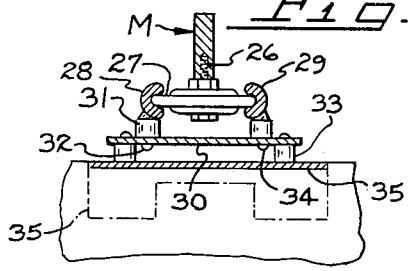
FIG. 8 is an enlarged transverse section through the adjustable means for supporting the free end of the arcuate pawl carrying bar.

The arcuate basket advancing bar M has one end that is disposed adjacent to the end wall 16 of the modular A, slidably supported by the mechanism shown in FIGS. 6 and 8. The bar M has a stud 26 that connects a ball bearing wheel 27 to the underside of the bar so that the plane of the wheel lies in a horizontal plane, see FIG. 8. The rim of the wheel is received between two arcuate guides 28 and 29. These arcuate guides are adjustably connected to a supporting plate 30. The guide 28 has its ends welded to blocks 31—31, and these blocks in turn are connected to the plate 30 by studs 32—32 that are received in transversely extending slots in the plate. This permits the guide 28 to be moved toward or away from the ball bearing wheel 27. In like manner the guide 29 has its ends welded to blocks 33—33 and these blocks in turn are connected to the plate 30 by studs 34—34 that are received in transversely extending slots in the plate. The guide 29 can be adjusted toward or away from the ball-bearing wheel 27. The plate 30 is mounted on a bracket 35 which in turn is secured to the end wall 16 of the modular A.

The end of the arcuate bar M, disposed nearest the end wall 17 of the modular A, is likewise supported by the same mechanism that has just been described for supporting the end of the bar disposed adjacent to the end wall 16 of the modular. Like reference characters will be applied to similar parts for both bar supporting mechanisms and no further detailed description of them need be given.

The arcuate bar M in the modular A has its midportion slidably supported by the mechanism shown in FIGS. 6 and 7. A bracket N is adjustably connected to the outer wall of the modular A and this bracket can be raised or lowered and then secured in an adjusted position. A rollersupporting extension 36, see FIG. 7, is adjustably secured to the bracket N by a bolt 37 and this bolt rotatably carries a wheel 38 that contacts the outer surface of the arcuate bar M. The extension 36 has another upstanding bolt 39 and a wheel is rotatably carried by the bolt 39 and contacts the inner surface of the arcuate bar M, as shown in FIGS. 6 and 7. The arcuate bar M has its central portion riding on a roller 41 whose horizontal axle is carried by the outer end of the bracket N and by the extension 36.

What I have described for slidably supporting the ends and central portion of the pawl-carrying arcuate bar M, I duplicate for slidably supporting the arcuate bar M′, in the modular B. In FIG. 6, I show portions of the ends of the bar M′, and I have not illustrated the supporting means for this bar since it is a duplicate of the disclosed and described in detail for the bar M. I do show in FIG. 9 how the adjacent ends of the two arcuate pawl-carrying bars are operatively connected together. A clevis 42 is welded onto the end of the bar M that is disposed near to the end wall 17 of the modular A, and this clevis supports a bolt 43 in a vertical position and this bolt can rotate about its vertical axis. A stud 44 has its head welded to the bolt shank so that the axis of the stud will extend at right angles to the axis of the bolt 43.

In like manner the arcuate bar M′ has a clevis 42′ welded onto its ends and the clevis carries a bolt 43′ in a vertical position. A stud 44′ has its head welded to the bolt shank 43′ so that the axis of the stud will extend at right angles to the axis of the bolt 43′. A hollow rod 45 has a nut welded onto each end thereof and the studs 44 and 44′ have their threaded portions received in the nuts. The arrangement is such that when the rod 45 is rotated in one direction it will draw the adjacent ends of the two arcuate bars M and M′ toward each other and, when rotated in the opposite direction, it will space the bar ends farther apart. A tubular member 46 extends between the adjacent ends of the modulars A and B, and the hollow rod 45 is received within the tubular member 46. The bolts 43 and 43′ will rotate on their vertical axes as the arcuate pawl-carrying bars M and M′ are reciprocated back and forth in the direction of their lengths by a means hereinafter described. The hollow rod 46 that interconnects the two arcuate bars M and M′ will cause the bars to operate in unison.

The modular B has an upper spray manifold D′ that is removably mounted therein, see FIG. 4, and the modular also has a lower spray manifold E′, removably mounted therein, see FIG. 6. These two manifolds D′ and E′ are similar to the manifolds D and E. FIG. 12 shows a motor G′ operating a pump F′ for removing hot water from the tank B′ and delivering it through a pipe 47 to a vertical pipe 48 that interconnects the upper and lower manifolds D′ and E′ and feeds water to both of them for spraying onto the dishes as the basket J, in FIG. 6, is stepwise moved from the modular A and through the modular B. A water pipe 49 extends between the two water tanks A′ and B′ in order to maintain the water level the same in both tanks, see FIG. 12. It is possible to have a hot water inlet pipe for the tank B′ which is similar to the hot water feed pipe 13 for the tank A′, but none is shown. The overflow pipe for the tank A′, although not shown, could take care of any excess water in the tank B′ because this excess water in the tank B′ would enter the tank A′ by the pipe 49. A float controlled switch for stopping the flow of fresh hot water into the tank B′, and similar to the float controlled switch 14 for the tank A′, could be provided but none is shown.

In FIG. 4, I show the modular A provided with a waterproof inspection door P, and an enlarged horizontal detailed section through the door is illustrated in FIG. 5. The door has vertical side flanges 50 and 51 that are slidably mounted in door channel guides 52 and 53, respectively. I have found that the door P can be made waterproof by extending the door channel guides so that they will have angle-shaped portions 54 and 55 whose outer edges 54′ and 55′ will yieldingly contact the inner surface of the door. Any water trying to pass through the side edges of the door will be trapped first by the edges 54′ and 55′ of the angle-shaped flanges 54 and 55, respectively, since these edges yieldingly contact with the inner surface of the door. The door P has a handle 56 by means of which the door may be raised for inspecting the interior of the power scrapper compartment. The power wash modular B also has an inspection door P′, see FIGS. 1 and 2, which is provided with a handle 56′ that is of similar construction as the door P, and therefore no further detailed description need be given of the door P′.

FIG. 6 shows the power wash modular B connected to the final rinse modular C, which is illustrated in horizontal section in order that a straight conveyor bar Q be viewed. This conveyor bar Q has no pawls L because it is too short in length. The inner end of the bar Q is connected to the adjacent end of the arcuate bar M′ in exactly the same way as the two arcuate bars M and M′ are interconnected. The arcuate bar M′ has a clevis 57 at its end that carries a bolt 58 and the straight bar Q has a clevis 59 on its end which supports a bolt 60. A rod 61 interconnects the two bolts 58 and 60 and it is slidably received in a large diameter sleeve 62 that interconnects the two modulars B and C at a point below the openings through which the dish-carrying baskets pass. Therefore, a reciprocation of the straight bar Q will reciprocate both of the arcuate bars M and M', and the pawls L on these arcuate bars will stepwise advance the baskets J from the entrance opening 1 in the modular A through both of the modulars A and B, and on through the final rinse modular C and out through the exit opening 6. The baskets push each other through the modular C because the bar Q is not provided with any pawls.

Figure 10:
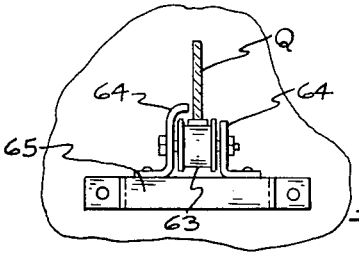
FIG. 10 is an enlarged transverse section through the conveyor bar in the final rinse compartment and illustrates how the bar is supported.

The end of the bar Q that carries the clevis 59 is slidably supported by a roller 63, see FIGS. 6 and 10. The roller 63 rotates on a horizontal axis and is mounted between a pair of angle members 64 which in turn are mounted on a bracket 65 that is secured to a wall of the modular C, as shown in FIG. 6. The outer end of the straight conveyor bar Q is connected to a jamb-proof yielding lever R, shown in FIGS. 1, 2, 3 and 6. This lever was disclosed in U.S. Pat. No. 2,689,639, on a mechanism for moving dish-containing baskets of which I was a joint inventor with George J. Federighi.

The jamb-proof yielding lever R comprises a lower member 66, see FIGS. 2, 3 and 3A, that is pivoted at its lower end in bearings 67, which are mounted on the outer end wall of the modular C. An upper member 68 of the yielding lever R is pivoted at 69 to the end of the straight conveyor bar Q that projects beyond the outer end of the modular C. A rod 70 is carried by the lower end of the upper lever member 68, see FIG. 3A and a tension coil spring 71 has its upper end connected to the rod 70 and its lower end connected to the pivot rod that is mounted in the bearings 67. Also, the lower end of the upper member 68 carries inwardly extending pins 72—72 that are receivable in recesses 73—73 provided in the upper ends of both side walls of the lower member 66.

FIGS. 2 and 3A show the lower part 66 of the yielding lever R provided with a member 74 that is attached to one side of the part 66 and has an elongated slot 75. An electric motor S operates a gear reduction mechanism 76 which in turn rotates a disc 77 at a desired slow speed. A pin 78 is eccentrically mounted on the disc 77 and this pin is received in the slot 75 provided in the member 74. Therefore, when the motor S is operated, the disc 77 will rotate and cause the eccentric pin to move in the slot 75 to cause the lower member 66 of the yielding lever R to swing back and forth in the bearings 67. The tension spring 71 is strong enough to hold the upper part 68 of the lever R so that all pins 72 will remain in their recesses 73 and the upper part 68 will swing as a unit with the lower part 66. Since the upper part 68 is connected to the straight conveyor bar Q, see FIGS. 3 and 3A, the back and forth movement of the lever R will reciprocate the bar Q and also the arcuate bars M' and M, see FIG. 6. In this way the dish-carrying baskets J are stepwise advanced through all three modulars A, B and C, when once the operator has moved the basket into the modular A.

If for any reason a basket J should become jammed while being stepwise moved through the three modulars A, B and C, the motor S would continue to operate and the eccentrically mounted pin 78 on the rotating disc 77 would continue to swing the lower part 66 of the lever R back and forth as indicated by the dot-dash position of the part 66 in FIG. 3. However, the jammed basket J would prevent the arcuate pawl-carrying bars M and M', and the straight bar Q from reciprocating. The resistance tension spring 71 in the lever R is now overcome and the pivot pin 69 that connects the upper lever part 68 with the bar Q cannot move, but the upper part 68 will swing about the now stationary pin 69 and the lower edge of the upper part 68 will swing as the recesses 73 will move the pins 72. This is indicated by the dot-dash line position of the upper part 68 in FIG. 3. No undue strain is placed on the operating motor S while the basket J remains jammed.

I provide means for activating hot water spray nozzles in the final rinse only when a basket containing washed dishes is moving through the final rinse modular C, see FIGS. 3 and 6. The final rinse water must be at a temperature of 180° F in order to sterilize the dishes, while the wash water needs to be 140° F. In order to save on the final rinse water, the valve controlling the final rinse will only be opened when there is a basket J of dishes in the rinse compartment C. I use the automatic mechanism disclosed in U.S. Pat. No. 2,668,548, on a magnetic mechanism for controlling flow of rinse water in dishwashing machines of which I was a joint inventor with George J. Federighi.

The pair of spaced apart straight basket-receiving tracks K in the final rinse compartment C, shown in FIG. 6, slidably receive the basket J as it leaves the arcuate tracks H' in the modular B. Both FIGS. 3 and 6 show the right hand straight track K as having an opening 79 through which the upper end 80 of a rinse control lever T projects. The lever T is pivoted at 81 and its lower end houses a permanent magnet 82. When the lever is in normal position, the magnet 82 will be positioned adjacent to the bottom wall 83 of the final rinse compartment C. A conventional mercury switch is mounted in a housing 84 and when the magnet 82 is positioned directly above the switch, one of the terminals, not shown, in the switch will be held away from making an electrical connection with the other terminal and thus the switch will be held in open position by the attraction of the magnet 82. The metal sheet forming the bottom wall 83 is made of non-magnetic material. The upper end 80 of the lever T will project above the track X when the lever T is in normal position.

As soon, however, as a basket J is received on the tracks K in the final rinse modular C, see FIG. 3, the weight of the basket will strike and swing the upper end 80 of the lever T and will swing the lower end with its magnet 82 away from the switch 84 and permit the switch to close. The closed switch closes an electric circuit, not shown, to open a solenoid-controlled hot water valve 85 and this will permit final rinse water at 180° temperature to flow from the hot water supply pipe 86 to a pipe 87 that feeds the hot water under pressure to a lower water spray manifold 88 and an upper water spray manifold 89. As soon as the basket J moves off from the upper end 80 of the lever T, the lever will return to normal position and its magnet 82 will again open the switch 84 and permit the solenoid-controlled valve 85 to shut off any further flow of rinse water.

I provide means for conveying the rinse water from the final rinse compartment C, see FIG. 3, back to the tank A' in the modular A, see also FIG. 12, after the rinse water has been sprayed upon the dishes for sterilizing them. A pipe 90 communicates with the bottom of the final rinse compartment and this pipe extends to the modular A where the outlet end of the pipe 90 will deliver the hot water adjacent to the end wall 17 of the modular A, see FIG. 11B, and just above the wash tank A'. A plurality of removable screens U are mounted at the top of the wash tank A', see FIG. 11B, and under the lower spray manifold E in the modular A, as shown in FIG. 11. The screens form a downwardly inclined plane and are supported in any manner desired, such as by inclined angle irons 91 secured to the sides of the wash water tank A'. The pump F will force water from the tank A' through the upper spray manifold D and the lower spray manifold E to wash the dishes moving through the modular A and the food soil from the dishes will drop upon the screens U. The hot water from the pipe 90 will move the food soil to the lower end of the inclined screens U where the food soil will enter an outlet pipe 92, see FIG. 11.

The hot water from the pipe 90 will flow through the openings in the screens U and will mix with the wash water in the tank A' and raise the temperature of the water, see FIG. 11B. Some of the rinse water will enter the outlet pipe 92, shown in FIG. 11, and will carry any food soil with it, as shown in FIG. 11. The outlet pipe 92 communicates with a scrap catchment, indicated generally in FIG. 12. The same scrap catchment V is also shown in FIGS. 1 and 2. The view of the scrap catchment in FIG. 2 shows it in the form of a box-like container that is inclined. A refuse basket V' is removably received in the scrap catchment V and it is provided with a handle 93 by means of which the basket may be withdrawn when it is desired to empty its contents. The refuse basket V' has perforated walls which will permit water to pass therethrough, but not the food soil that is delivered to the scrap catchment by the pipe 92, as shown in FIG. 2. A hinged cover 94 normally closes the upper end of the inclined scrap catchment V and a drain pipe 95 communicates with the lower end.

Referring again to FIGS. 11 and 11B, it will be noticed that the lower portion of the downwardly inclined screens U in the modular A are covered by a removable plate 96 which is inclined in the manner shown. This is to prevent the food soil from the washed dishes from striking the end wall 97 of the wash tank A'. The inclined plate 96 will cooperate with the oppositely inclined screens U for directing the food soil into the outlet pipe 92 that in turn conveys the food soil to the scrap catchment V and delivers it at a point above the removable basket V' that is received in the scrap catchment. A portion of the lower spray manifold E in the modular A has been broken away in order to show that the outlet pipe 92 communicates with the wash tank A' at the lowest point where the inclined screens U meet the lower edge of the removable plate 96, see FIG. 11.

In FIGS. 11 and 11A, I show the top of the tank B' covered with a plurality of removable screens U' that may be supported in any manner desired, such as by angle irons 98 secured to opposite sides of the tank. The angle irons 98 lie in the same horizontal plane and, therefore, support the removable screens U' in a horizontal plane and not on an inclined plane as is true of the screens U in the modular A. The motor driven pump F' in FIG. 12 will remove hot water from the tank B' in the modular B and will force it through the upper spray manifold D' and the lower spray manifold E', see FIG. 11, for rinsing the dishes passing through the modular B. The water will then drain through the removable screens U', and back into the tank B' where it will again be recycled. The pipe 49, in FIG. 12, that interconnects the tanks A' and B' maintains the water in both tanks at the same level. If desired, the modular B may have its own hot water filling pipe, not shown, for the initial entrance of hot water into the tank B' when the dishwasher is to be used. Also, an overflow pipe, not shown, for the tank B' may be provided.

FIG. 12 shows a drain pipe 99 communicating with the bottom of the tank A' in the modular A and also shows a drain pipe 100 communicating with the bottom of the tank B' in the modular B. A valve 101 normally closes the drain pipe 99 and an extended valve handle 102 may be manually actuated for opening and closing the valve. In like manner a valve 103 normally closes the drain pipe 100 and an extended valve handle 104 may be manually actuated for opening and closing the valve.

OPERATION

From the foregoing description of the various parts of the device, the operation thereof may be readily understood. When the dishwashing machine is to be used, the tank A' in the modular A is filled to the proper depth with hot wash water having the proper amount of detergent therein. The tank B' in the modular B is also filled to the proper depth with hot rinse water. The motors C and C', see FIG. 12, are then started for causing the spray manifolds D and E in the modular A to deliver a power wash to any dishes passing through the modular. The motor S, see FIG. 2, is also started and this will cause the two interconnecting arcuate bars M and M', see FIG. 6, to reciprocating as well as the straight bar Q.

The operator feeds a dish-carrying basket J from the feed table 4, see FIG. 1, into the entrance opening 1 of the modular A. The pawls L on the arcuate bar M will stepwise advance the basket J through the modular A where the power wash from the spray manifolds D and E will wash the dishes. The basket J travels along the arcuate track H in the modular A and the direction of travel of the basket will be through a 90° arc. The basket then moves into the modular B and is stepwise advanced through this modular by the reciprocating arcuate bar M' and its pawls. The basket J travels along the arcuate track H' in the power wash modular B and the direction of travel of the basket will be through another arc of 90°. Then the basket J with its washed and rinsed dishes is moved through the final rinse modular C by the next adjacent basket that is being moved through the modular B. The basket, while in the final rinse modular C, will depress the upwardly extending end 80 of the rinse water control lever T, see FIG. 3, and will swing the lever so that its magnet 82 will move away from the magnetically controlled switch 84 and permit this switch to close an electric circuit to the solenoid valve 85 for opening it. Hot rinse water will be sprayed from lower and upper spray manifolds 88 and 89 against the dishes for sterilizing them. The basket of washed, rinsed and sterilized dishes will then be moved out from the final rinse modular C and onto the receiving table 5.

Although I have described the arcuate modular A as a power scrapper unit, and the arcuate modular B as a power rinse unit, they could be used for other purposes and in different arrangements. The power scrapper modular could be a power wash unit if desired. In FIGS. 13, 14 and 15, I illustrate schematically a few of the other arrangements of the arcuate modulars by way of example.

In FIG. 13 the arcuate power scrapper A is connected to the arcuate power rinse B by a straight power wash unit W and the three units or modulars are S-shaped. The scrap catchment V is placed adjacent to the power scrapper A and the final rinse modular C is placed adjacent to the power rinse B. This type of arrangement of the various modulars A, W, B and C, is particularly advantageous when an isolation of the load end A from the unload end C of the dishwasher becomes necessary (as in many hospital dishroom layouts). An angle-shaped partition X, in FIG. 13, has an opening therein through which the S-shaped dishwashing machine extends so that the soiled dishes are in one room and the sterilized dishes are delivered into another room. I have indicated the arcuate reciprocating bars M and M′ by dotted lines for moving the dish-carrying baskets, not shown, and these are connected to a straight bar Y, reciprocably mounted in the power wash modular W and to the straight bar Q, reciprocably mounted in the final rinse modular C.

Another arrangement of modulars is shown schematically in FIG. 14. The scrap catchment V is placed adjacent to the arcuate-shaped power scrapper A and the power scrapper in turn is connected to a two tank conveyor straight modular W′ that includes a power wash, a power rinse and a final rinse. This type of dishwashing machine can be placed in the corner of a room, as indicated by the angle-shaped partition X′. The dish-carrying baskets, not shown, are stepwise advanced through the modular A by the reciprocable arcuate bar M and are advanced through the modular W′ by the reciprocable straight bar Y′ that is connected to the arcuate bar M.

Still another corner installation of the various modulars is shown in FIG. 15 where a straight power wash modular W is connected to an arcuate power rinse modular B and this in turn is connected to the final rinse modular C. The reciprocable arcuate bar M′ in the modular B has one end connected to a straight bar Y in the modular W and has its other end connected to the straight bar Q in the modular C. The dish-carrying baskets with their soiled dishes are fed into the straight power wash modular W and the reciprocating straight bar Y with its pawls, not shown, will stepwise advance the baskets through the modular Y and the reciprocating bar M′ will move the baskets through the power rinse modular B and out through the final rinse C.

Referring to FIGS. 1 and 6, it will be seen that the end of the conveyor bar Q that projects beyond the final rinse modular C extends through an opening 105 in the end wall 106 of the modular C. A trough 107 underlies the portion of the bar Q extending beyond the unit C and catches any water escaping through the opening 105 and returns it into the final rinse unit. FIG. 6 shows how the trough 107 is provided with outwardly extending projections that contact the end wall 106 and are secured in place by rivets.

It will be seen that the various arrangements of the modulars in FIGS. 1A, 13, 14 and 15, illustrate a most versatile corner conveyor dishwashing machine. The arcuate sections A and B can convey 20 inch racks, including 18 times 26 bun pans and oval banquet trays, not shown, around a ninety degree corner on an arcuate track. The arrangement shown in FIG. 1A can take up a minimum space requirement of about 80 inches with a space of about 29 inches between soiled and clean dishes. From this minimum space requirement other combinations of the modulars can be arranged, such as those shown in FIGS. 13, 14 and 15, by way of example. These modulars can power scrap, power wash, power rinse and then finish with an isolated, straight final sanitizing rinse in the modular C. Any of the modulars can move the dish-carrying baskets in either direction by simply changing the direction of the pawls L. All or only one modular can be used in a dishroom layout.

The straight bars Y, in FIGS. 13, 14 and 15, may be provided with pawls for stepwise advancing the dish-carrying baskets in the same manner as the arcuate bars M and M′ are provided with spaced apart pawls.

The dishes are placed in the basket so that their front and rear faces extend substantially at right angles to the direction of travel by the basket. The wash and rinse spray arms in the arcuate modulars extend transversely across the arcuate path taken by the dish-carrying basket at all times so that the front and back of each dish in the basket will receive the full force of the jet sprays at all times as the basket is moved stepwise through the arcuate unit. This arrangement will produce a far better washing and rinsing effect on the dishes than in some dishwashers where the basket is moved in a straight line for a certain distance in one section of the dishwasher and then the basket is moved at right angles to its former travel for a further washing or rinsing of the dishes in the next section of the dishwasher. In the second section the jet sprays will substantially parallel the planes of the dishes rather than be at right angles to the faces of the dishes. The washing and/or rinsing effect on the dishes in the second section will therefore be greatly reduced.

I have provided a commercial dishwasher that is composed of one or more modulars or units in which at least one of the units is an arcuate modular that will cause the dish-carrying basket to be stepwise moved along a curved track. A large number of different configurations is made possible by interconnecting arcuate units with straight or other arcuate units.

I claim:

1. In a dishwashing machine:

a. a first arcuate-shaped dishwashing modular having an entrance opening at one end and an exit opening at the other end through which dish-carrying baskets may pass;

b. a second arcuate-shaped dish-rinsing modular coupled to said first arcuate-shaped dishwashing modular with a gasket positioned between the two modulars for effecting a hermetic seal between the two modulars;

c. said second arcuate-shaped dish-rinsing modular having an entrance opening at one end and placed adjacent to the exit opening of said first arcuate-shaped dishwashing unit so that the dish-carrying baskets can pass between the two hermetically sealed modulars, said second arcuate-shaped dish-rinsing modular having an exit opening at its other end;

d. an arcuate basket-supporting and guiding stationary track extending between the two openings in each of the two arcuate-shaped modulars and providing the only support for the dish-carrying baskets as they pass through the two arcuate-shaped modulars, the space between the adjacent ends of the two arcuate-shaped tracks at the hermetically sealed junction between the two arcuate-shaped modulars being such that the baskets can freely pass from the arcuate-shaped track in said first modular onto the arcuate-shaped track in said second modular;

e. stepwise basket advancing means in each arcuate-shaped modular and including an arcuate-shaped reciprocating bar having basket engaging pawls, said bars being reciprocably mounted in each arcuate-shaped modular for causing said pawls to stepwise engage the baskets in the modulars for moving the baskets through both modulars only when said arcuate bars are moving toward the exit ends of both modulars;

f. adjustable coupling means interconnecting the adjacent ends of the two arcuate-shaped bars and being removable from said bars to permit the separation of the modulars; and g. means for reciprocating the two arcuate-shaped bars as a unit.

2. The combination as set forth in claim 1, and in which a. said adjustable coupling means can be adjustably connected to the adjacent end of one of said arcuate bars and can be adjustably connected to the adjacent end of the other said arcuate bar.

* * * * *